US012049245B2

(12) United States Patent
Yu et al.

(10) Patent No.: US 12,049,245 B2
(45) Date of Patent: Jul. 30, 2024

(54) METHOD AND DEVICE FOR COOPERATIVE CONTROL OF MULTIPLE TRAINS

(71) Applicant: BEIJING JIAOTONG UNIVERSITY, Beijing (CN)

(72) Inventors: Zujun Yu, Beijing (CN); Hongwei Wang, Beijing (CN); Li Zhu, Beijing (CN); Xi Wang, Beijing (CN); Siyu Lin, Beijing (CN); Mingzhao Hao, Beijing (CN); Qianqian Zhao, Beijing (CN)

(73) Assignee: BEIJING JIAOTONG UNIVERSITY, Beijing (CN)

( * ) Notice: Subject to any disclaimer, the term of this patent is extended or adjusted under 35 U.S.C. 154(b) by 403 days.

(21) Appl. No.: 17/410,975

(22) Filed: Aug. 24, 2021

(65) Prior Publication Data

US 2022/0055672 A1 Feb. 24, 2022

(30) Foreign Application Priority Data

Aug. 24, 2020 (CN) ..... 202010858087.1

(51) Int. Cl.
*B61L 27/00* (2022.01)
*B61L 25/02* (2006.01)
(Continued)

(52) U.S. Cl.
CPC ..... *B61L 27/16* (2022.01); *B61L 25/021* (2013.01); *B61L 27/20* (2022.01); *B61L 27/70* (2022.01); *B61L 2027/204* (2022.01)

(58) Field of Classification Search
CPC ..... B61L 27/16; B61L 27/20; B61L 27/70; B61L 25/021; B61L 2027/204
(Continued)

(56) References Cited

U.S. PATENT DOCUMENTS 2,133,627 A * 10/1938 McCann ..... B61L 19/06 246/122 R
3,250,914 A * 5/1966 Reich ..... B61L 25/023 246/63 R
(Continued)

OTHER PUBLICATIONS

Sohail A. Dianat, Eli S. Saber, "Advanced Linear Algebra for Engineers with Matlab"; C2009 Taylor & Francis Group, Boca Raton FL; ISBN-13: 978-1-4200-9523-4. p. 263-266; (Year: 2009).*

*Primary Examiner* — Logan M Kraft
*Assistant Examiner* — John D Bailey
(74) *Attorney, Agent, or Firm* — Renner, Otto, Boisselle & Sklar, LLP

(57) ABSTRACT

Embodiments of the present disclosure provide a method and a device for cooperative control of multiple trains. The method includes: S1, establishing a train dynamic model of urban rail transit; S2, modeling a train control system of urban rail transit based on train-to-train communication; S3, constructing, according to the dynamic model and a control system model, an optimized control target which comprehensively considers distance convergence and speed convergence of train formation; and S4, cooperatively controlling, on the basis of an artificial potential field method and Kalman filtering and according to the optimized control target, the multiple trains. The present disclosure is capable of effectively shortening a train headway.

6 Claims, 5 Drawing Sheets

(51) Int. Cl.
*B61L 27/16* (2022.01)
*B61L 27/20* (2022.01)
*B61L 27/70* (2022.01)

(58) Field of Classification Search
USPC ..... 701/19
See application file for complete search history.

(56) References Cited

U.S. PATENT DOCUMENTS 5,029,294 A * 7/1991 Kim ..... B61L 3/126 318/587
5,332,180 A * 7/1994 Peterson ..... B61L 15/0092 701/509
8,905,360 B2 * 12/2014 Xu ..... B61L 23/18 701/19
9,043,131 B2 * 5/2015 Carlson ..... B61L 15/0027 701/538
11,021,178 B2 * 6/2021 Ghaly ..... B61L 27/20
2005/0107954 A1 * 5/2005 Nahla ..... B61L 25/023 701/19
2006/0119489 A1 * 6/2006 Shinada ..... B60Q 1/5035 340/901
2008/0269967 A1 * 10/2008 Kumar ..... B61L 27/16 701/19
2009/0143928 A1 * 6/2009 Ghaly ..... B61L 19/06 701/19
2010/0023190 A1 * 1/2010 Kumar ..... B61L 27/53 701/20
2012/0018591 A1 * 1/2012 Ghaly ..... B61L 3/008 701/19
2013/0218375 A1 * 8/2013 Ning ..... B61L 27/00 701/19
2014/0054424 A1 * 2/2014 Xu ..... B61L 27/20 246/122 R
2015/0232097 A1 * 8/2015 Luther ..... G01C 21/3415 701/1
2016/0009304 A1 * 1/2016 Kumar ..... B61L 27/40 701/19
2017/0113707 A1 * 4/2017 Ghaly ..... B61L 23/14
2017/0305396 A1 * 10/2017 Shiratsuchi ..... B61L 23/14

* cited by examiner

METHOD AND DEVICE FOR COOPERATIVE CONTROL OF MULTIPLE TRAINS

This patent application claims the benefit and priority of Chinese Patent Application No. 202010858087.1, filed on Aug. 24, 2020, the disclosure of which is incorporated by reference herein in its entirety as part of the present application.

TECHNICAL FIELD

The present disclosure relates to the field of traffic, in particular to a method and a device for cooperative control of multiple trains.

BACKGROUND ART

With economic boom and rapid urbanization, urban rail transit has become the main artery of public transport in large and medium-sized cities as well as megalopoli. Over half of passengers are transported by public traffic trains in megalopoli such as Beijing and Shanghai. Therefore, such megalopoli like Beijing, Shanghai and Guangzhou are still under huge pressure of passenger transport. Subway Line 10, Subway Line 4, Subway Line 13, etc. in Beijing have all pre-fulfilled or exceeded forward passenger flow forecast values. The maximum load factor of passenger flow at rush hours even reaches 120% or higher. The passenger flow of the urban rail transit has two features. One is the tidal feature, that is, passenger flow into cities at the morning peak is large and concentrated, and the opposite is true at the evening peak. In addition, transfer stations have large passenger flow. To relieve the pressure of passenger flow, more trains are put into use, with both departure intervals and station dwell time shortened. Taking tidal passenger flow as an example, too many trains in the peak direction of passenger flow will lead to train bunching in turn-back sections. Besides, a unified "all-stop" transportation organization mode of the urban rail transit will lead to waste of transport capacities in the direction of relatively small passenger flow and sections of small passenger flow. As a result, a sharp contradiction between transportation modes for the unbalanced distribution and the balanced distribution of passenger flow is created.

Communication-based train control (CBTC) is a key technology of the urban rail transit. In order to improve the efficiency, a moving block mode is widely used in train running control of the urban rail transit. Specifically, a current train takes the tail of a preceding train as a tracking target and keeps a stable safety protection distance to the preceding train. In the moving block mode, the train conforms to a mode of train headway control based on absolute braking distance and a mode of train headway control based on relative braking distance during running.

In the mode of train headway control based on absolute braking distance, the current train considers that the preceding train is in a fixed position and will not collide a "hard wall", that is the fixed position. This mode requires the train to brake at proper deceleration so as to stop safely in front of the "hard wall".

In the mode of train headway control based on relative braking distance, not only the position but also the speed of the preceding train should be considered. The current train will consider dynamic running parameters of the preceding train during running, and then adjust and decelerate to avoid collision with the preceding train, thus achieving the purpose of safe driving.

In most urban rail transit lines, only the mode of train headway control based on absolute braking distance is used by the moving block. Although the moving block already greatly shortens the departure intervals of the trains and improves the transport capacity of the lines, long train running distances in the mode keep unchanged. Especially in special scenes of tidal passenger flow, etc., the train turnover efficiency cannot satisfy transport demands in directions and sections of high passenger flow. Its underlying reason if investigated is that under the existing train running control mode, even in the mode of train headway control based on relative braking distance, a movement authority (MA), generated by a zone controller (ZC) according to position information of the preceding train, controls forward running decisions of the train, instead of the current train itself. The train calculates the maximum safe speed according to the information of the preceding train covered by MA, and formulates its own speed control strategies under the maximum safe speed. The trains cannot directly obtain the information of the preceding train for deciding the control strategies, so a control mechanism of the existing train control system still causes long train running intervals.

SUMMARY

An embodiment of the present disclosure provides a method for cooperative control of multiple trains, which is capable of effectively shortening a train headway.

The method for cooperative control of multiple trains includes:

S1, establishing a train dynamic model of urban rail transit;

S2, modeling a train control system of urban rail transit based on train-to-train communication;

S3, constructing, according to the dynamic model and a control system model, an optimized control target which comprehensively considers distance convergence and speed convergence of train formation; and S4, cooperatively controlling, on the basis of an artificial potential field method and Kalman filtering and according to the optimized control target, the multiple trains.

A device for cooperative control of multiple trains includes:

- an establishment unit used for establishing a train dynamic model of urban rail transit;
- a modeling unit used for modeling a train control system of urban rail transit based on train-to-train communication;
- a construction unit used for constructing, according to the dynamic model and a control system model, an optimized control target which comprehensively considers distance convergence and speed convergence of train formation; and
- a control unit used for cooperatively controlling, on the basis of an artificial potential field method and Kalman filtering and according to the optimized control target, the multiple trains.

In the present disclosure, the trains are modeled as a discrete linear time-invariant system, relative distance and a relative speed between the trains are taken as constraint conditions for controlling multi-train formation, in addition, influence of noise in an actual formation process is considered, and a Kalman filtering state observer is introduced to guarantee convergence and robustness of a potential field algorithm. According to a control strategy provided by the present disclosure, the train headway may be effectively shortened, and train resources on a line may be flexibly configured by means of the train formation as well, such that the control strategy has important practical significance.

Additional aspects and advantages of the present disclosure will be set forth partially in the following description, which will become obvious in the following description, or may be learned by practice of the present disclosure.

BRIEF DESCRIPTION OF THE DRAWINGS

To describe technical solutions of embodiments of the present disclosure more clearly, accompanying drawings required for description of the embodiments are briefly described below. Apparently, the accompanying drawings in the following description show merely some embodiments of the present disclosure, and a person of ordinary skill in the art may still derive other accompanying drawings from these accompanying drawings without creative efforts.

DETAILED DESCRIPTION OF THE EMBODIMENTS

Figure 1:
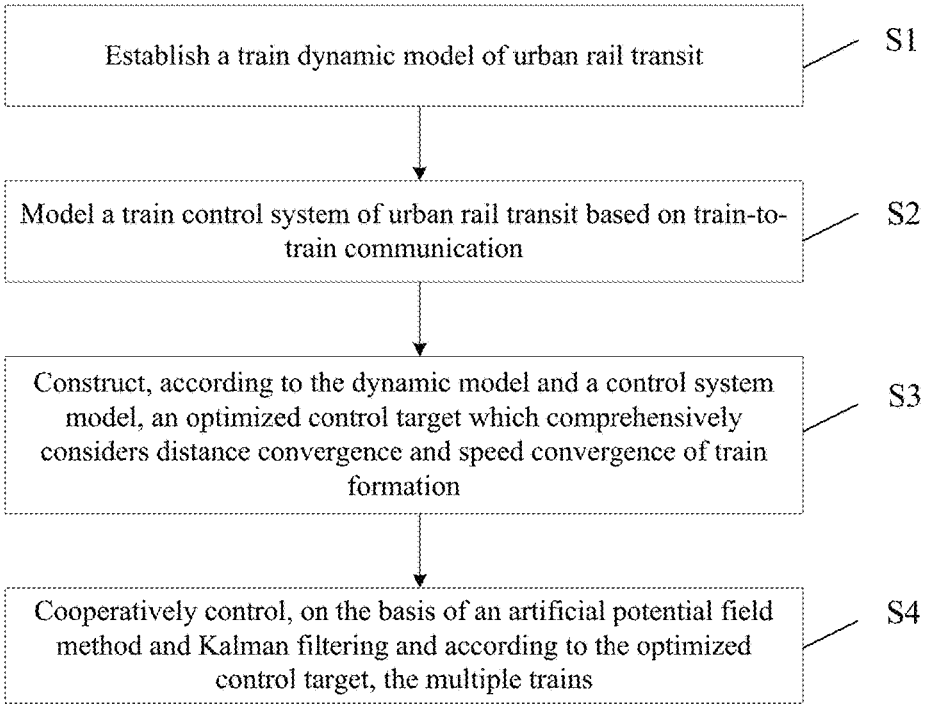
FIG. 1 is a schematic diagram of a method for cooperative control of multiple trains of the present disclosure.

Embodiments of the present disclosure are described in detail below, examples of the embodiments are shown in accompanying drawings, throughout which identical or similar reference numerals denote identical or similar elements or elements having identical or similar functions. The embodiments described below with reference to the accompanying drawings are exemplary and are merely used to explain the present disclosure, but cannot be interpreted as limiting the present disclosure.

In order to facilitate understanding of the embodiments of the present disclosure, several particular embodiments, taken as examples, will be further explained and described below with reference to the accompanying drawings, and each embodiment does not constitute a limitation on the embodiments of the present disclosure.

As shown in FIG. 1, a method for cooperative control of multiple trains of the present disclosure includes:

S1, establish a train dynamic model of urban rail transit;

S2, model a train control system of urban rail transit based on train-to-train communication;

S3, construct, according to the dynamic model and a control system model, an optimized control target which comprehensively considers distance convergence and speed convergence of train formation; and S4, cooperatively control, on the basis of an artificial potential field method and Kalman filtering and according to the optimized control target, the multiple trains.

The step 1 specifically includes:

the train dynamic model being:

$$x[k+1]=Ax[k]+Bu[k] \tag{1}$$

where x[k] is a train state in a $k^{th}$ communication cycle, u[k] is a potential field value output by a potential function, and A and B are parameter matrices separately; and the train statex[k] being expressed as follows:

$$x[k]=[s_i[k],v_i[k]]^T \tag{2}$$

where $s_i[k]$ and $v_i[k]$ represent a position and a speed of a train respectively.

The step 2 specifically includes:

add the train-to-train communication to a communication-based train control (CBTC) system to realize coexistence of the train-to-train communication and train-to-wayside communication, exchange, by trains running in formation, information with a control center through the train-to-wayside communication and information with adjacent trains through the train-to-train communication; add train cooperative operation to trains except a first train in a formation running mode to make state decisions; and send, in a train formation control algorithm, a formation instruction by automatic train supervision (ATS) of a ground center, the sent instruction including designation of a leader and a follower, specially, designation of the first train in the formation as the leader, and the rest trains in the formation as the followers, the first train running as the leader according to a timetable tracking an automatic train operation (ATO) curve, and the rest trains as the followers in the formation tracking a position and a speed of the first train.

The step 4 specifically includes:

S41: collect real-time running states of the trains in a communication topology and obtain a position and a speed of each train;

S42: input the position and the speed of each train into the potential function and the Kalman filter;

S43: calculate control force u[k] for each train according to the state potential function and the Kalman filter;

S44: apply the control force u[k] to each train; and

S45: repeat steps S41-S44 until the trains run to a destination.

The step 43 specifically includes:

step 431, establish, by a following train, communication with a preceding train;

step 432, receive, by the following train, u[k] output by a potential function of the preceding train;

step 433, receive y[k], by the following train, of the preceding train, y[k] including a speed and a position;

step 434, calculate $\hat{x}[k]$ by the following train according to a dynamic mathematical model of the preceding train;

step 435, calculate $\hat{y}[k]$ by the following train according to a mathematical model of an on-board sensor of the preceding train;

step 436, determine, by the following train, whether y[k] is converged to y[k], indicating that i[k] is converged to x[k] if a determination result is yes, and proceed to step 433 if the determination result is no; and step 437, use, by the following train, convergent x[k] to calculate u[k] output by a potential function of the following train.

The step 432 specifically includes:

a potential function for controlling distance between the trains being expressed as follows:

$$U_{is}(X_{ij})=\Sigma_{j=1}^{n}k_s*A_{ij}*\tan h(X_{ij}-d_{ij}) \quad (3)$$

where $X_{ij}$ is an actual running distance between train i and train j, $d_{ij}$ is an expected minimum safe distance between the train i and the train j, and $k_s>0$ determines a coefficient of input control; $A_{ij}$ is an adjacency matrix corresponding to a communication topology structure of a multi-train formation system; an internal variable of $A_{ij}$ is $a_{ij}$, which indicates an information sharing state between trains in the formation, $a_{ij}$ equaling 1 and 0 indicates that an information link is normal and abnormal respectively; when $X_{ij}=d_{ij}$, a distance control function between two adjacent trains equals 0, that is, when two trains have an expected distance, an absolute value of the distance control function is a global minimum; and when $X_{ij}>d_{ij}$, the potential function is positive, attraction between the two trains shortens the distance between the two trains to make the two trains approach each other, and when $X_{ij}<d_{ij}$, the potential function is negative, and repulsion occurs between the two trains to repel the two trains;

a potential function of speed control being expressed as follows:

$$U_{iv}(V_i)=-\Sigma_{j=1}^{n}k_v*A_{ij}*\tan h(V_i-V_j) \quad (4)$$

where $k_v>0$ is a gain coefficient of the potential function, $V_i$ is an actual speed of the train i, and $V_j$ is a speed of another train in the communication topology.

A summed potential field of a distance potential field and a speed potential field is an output of a total potential field, and the total potential field is denoted as $U_i^{ARF}$.

$$U_i^{ARF}=U_{is}(X_{ij})+U_{iv}(V_i)+U_{rep}(q_i) \quad (5)$$

The present disclosure further provides a device for cooperative control of multiple trains. The device includes:

an establishment unit used for establishing a train dynamic model of urban rail transit;

a modeling unit used for modeling a train control system of urban rail transit based on train-to-train communication;

a construction unit used for constructing, according to the dynamic model and a control system model, an optimized control target which comprehensively considers distance convergence and speed convergence of train formation; and a control unit used for cooperatively controlling, on the basis of an artificial potential field method and Kalman filtering and according to the optimized control target, the multiple trains.

The following describes an application scene of the present disclosure.

The present disclosure relates to the method for cooperative control of multiple trains considering the train-to-train communication. By means of the train-to-train communication, a cooperative control algorithm is used to replace mechanical couplers of the trains to connect the trains virtually, so as to realize ultra-short distance and ultra-high density train tracking, which is the design problem of a cooperative controller for train formation based on a multi-particle model.

Figure 2:
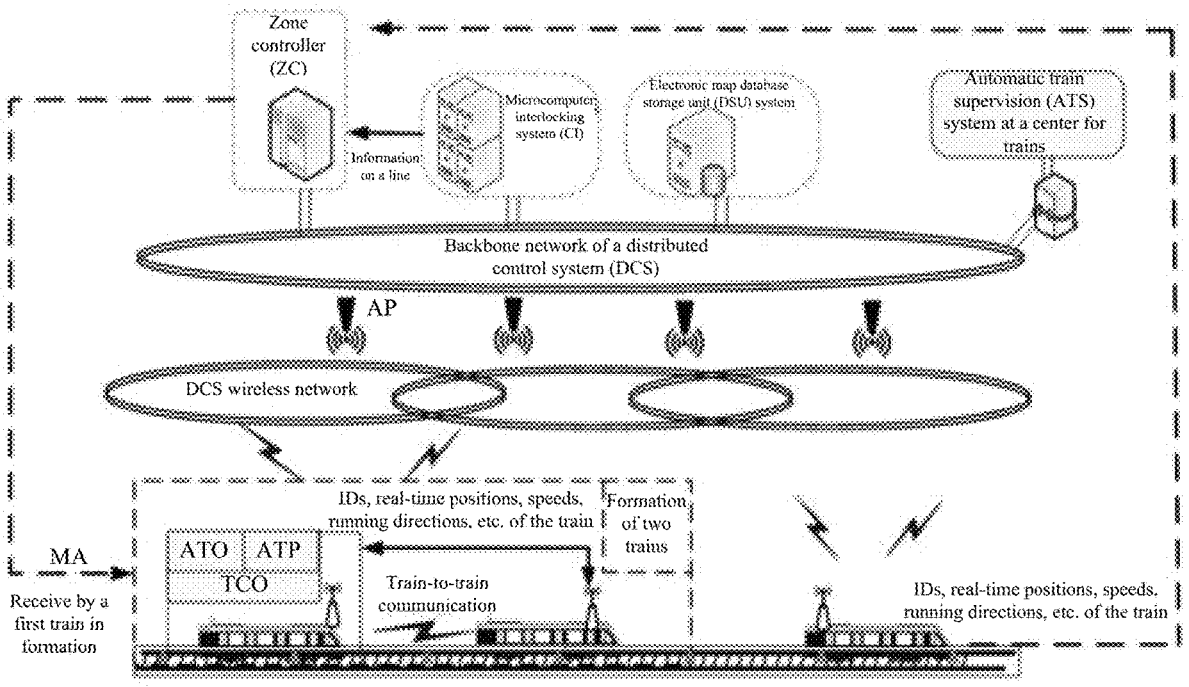
FIG. 2 is a schematic diagram of a communication-based train control (CBTC) system additionally provided with a train formation mode in an application scene of the present disclosure.
Figure 3:
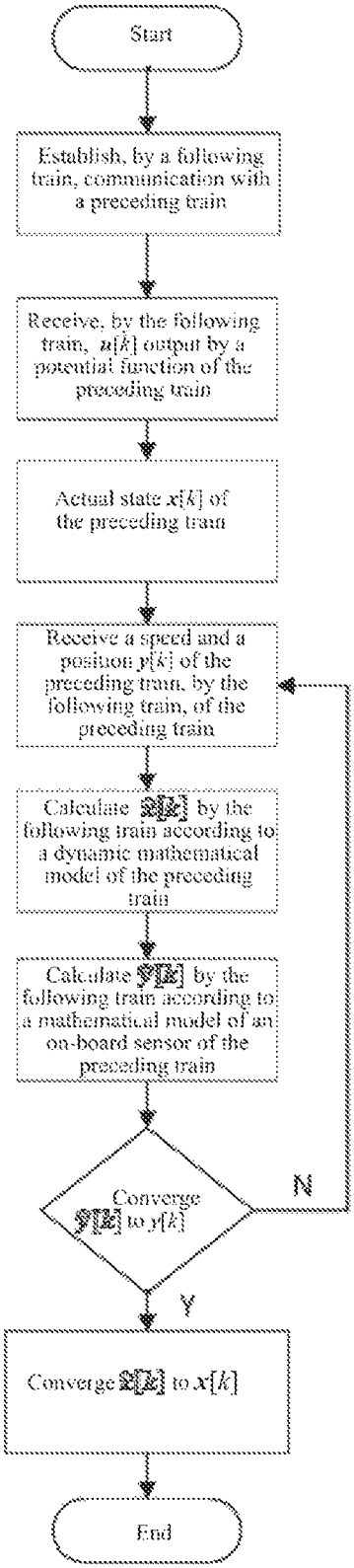
FIG. 3 is a schematic workflow diagram of a train state observer in an application scene of the present disclosure.
Figure 4:
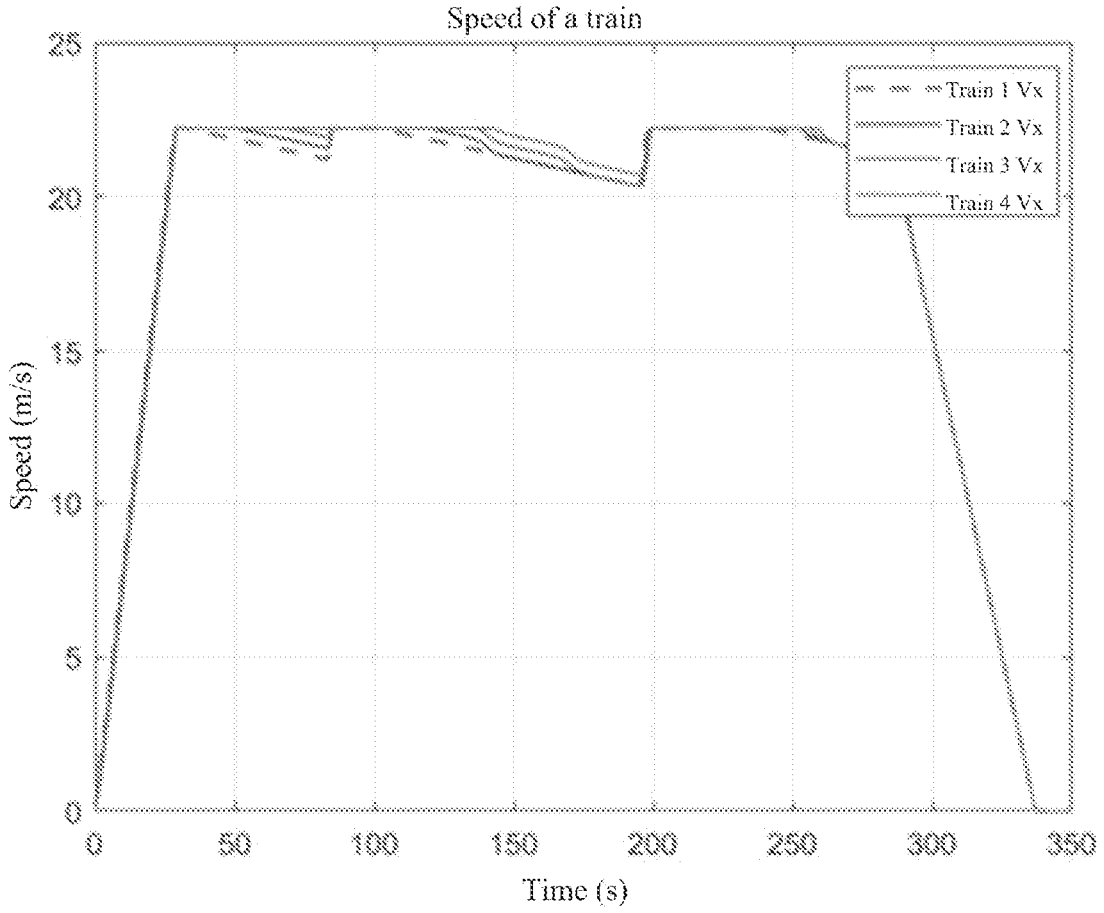
FIG. 4 is a schematic diagram of a train speed in a formation mode in an application scene of the present disclosure.
Figure 5:
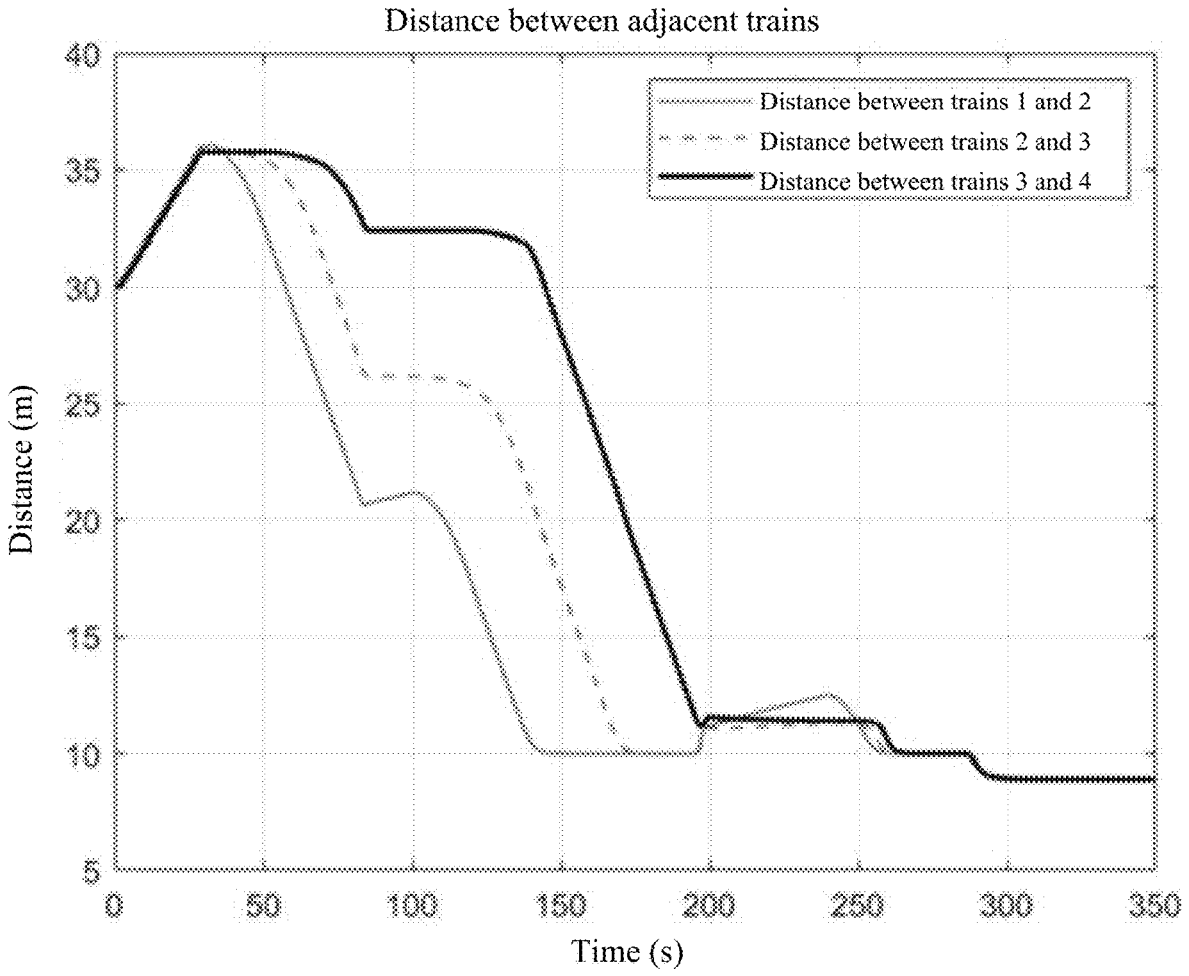
FIG. 5 is a schematic diagram of a distance between adjacent trains in a formation mode in an application scene of the present disclosure.
Figure 6:
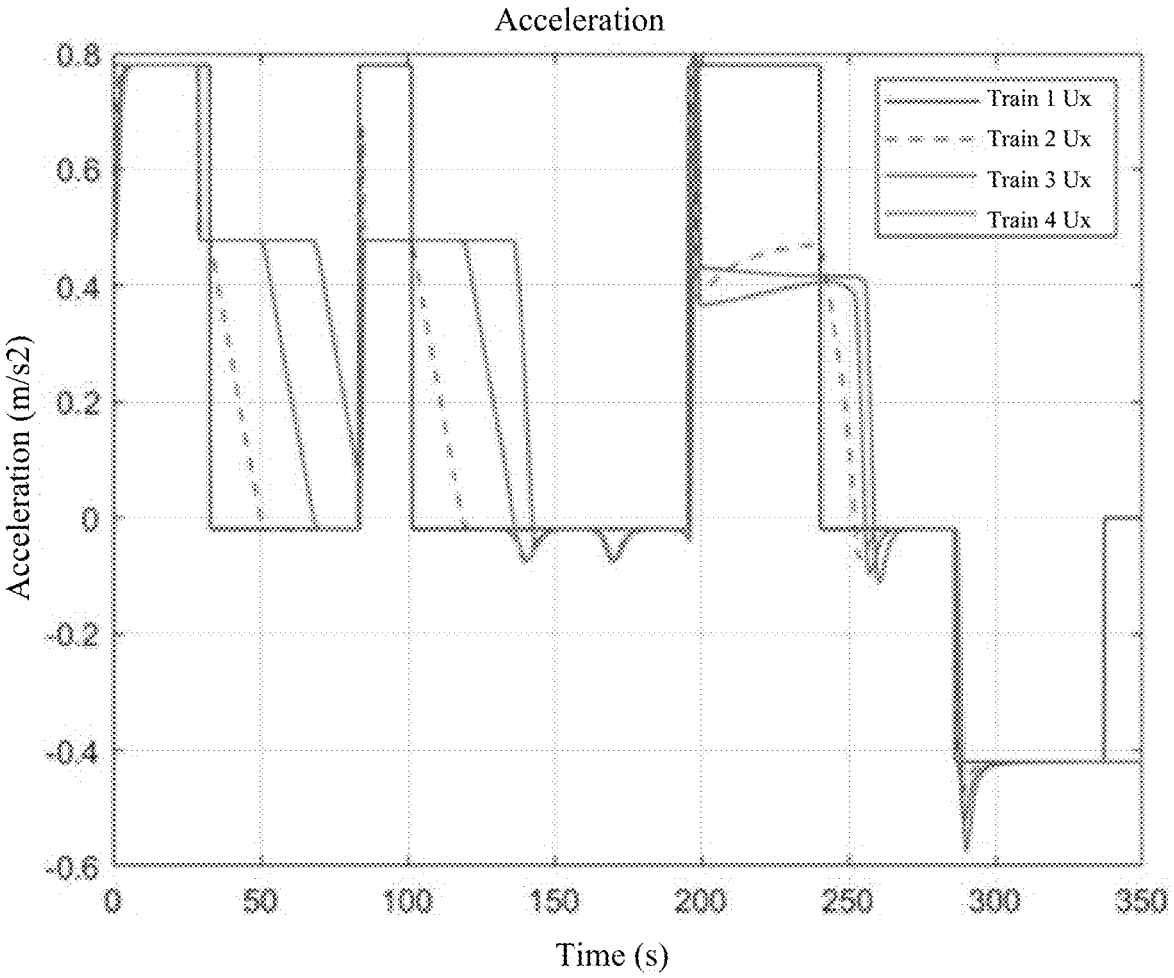
FIG. 6 is a schematic diagram of train acceleration in a formation mode in an application scene of the present disclosure.

FIG. 2 is a schematic diagram of a communication-based train control (CBTC) system additionally provided with a train formation mode in an application scene of the present disclosure, FIG. 3 is a schematic workflow diagram of a train state observer in an application scene of the present disclosure, FIG. 4 is a schematic diagram of a train speed in a formation mode in an application scene of the present disclosure, FIG. 5 is a schematic diagram of a distance between adjacent trains in a formation mode in an application scene of the present disclosure; and FIG. 6 is a schematic diagram of train acceleration in a formation mode in an application scene of the present disclosure. The following will give descriptions with reference to each figure. The present disclosure provides the method for cooperative control of multiple trains based on the artificial potential field method and Kalman filtering. The method includes:

S1: establish a train dynamic model of urban rail transit;

S2: model a train control system of urban rail transit based on train-to-train communication;

S3: construct, according to the dynamic model and a control system model, an optimized control target which comprehensively considers distance convergence and speed convergence of train formation; and S4: design a multi-train cooperative controller based on the artificial potential field method and Kalman filtering, whose particular control method includes steps:

S41: collect real-time running states of the trains in a communication topology and obtain a position and a speed of each train;

S42: input the position and the speed of each train into the potential function and the Kalman filter;

S43: calculate control force u[k] for each train according to the state potential function and the Kalman filter;

S44: apply the control force u[k] to each train; and

S45: repeat steps S41 and S44 until the trains run to a destination.

A modeling process of controlling multi-train formation is as follows:

1. A train dynamic model of urban rail transit since the train-to-train communication is periodic, the train may be modeled as a discrete linear time-invariant system. The train dynamic model is as follows:

$$x[k+1]=Ax[k]+Bu[k] \quad (1)$$

where x[k] is a train state in a $k^{th}$ communication cycle, u[k] is a potential field value output by a potential function, and A and B are parameter matrices separately.

In the train dynamic model, a train state includes a position and a speed of the train. the train state x[k] is expressed as follows:

$$x[k]=[s_i[k],v_i[k]]^T \quad (2)$$

where $s_i[k]$ and $v_i[k]$ represent a position and a speed of a train respectively.

2. Establishment of a train control model of urban rail transit based on train-to-train communication The train-to-train communication is added to a communication-based train control (CBTC) system to realize coexistence of the train-to-train communication and train-to-wayside communication, and trains running in formation exchange information with a control center through the train-to-wayside communication and information with adjacent trains through the train-to-train communication. In a formation running mode, other trains except the first train no longer calculate an automatic train protection (ATP) curve of the trains according to a movement authority (MA) provided by a zone controller (ZC), but make state decisions by being additionally provided with train cooperative operation (TCO), such that a train headway may be shorter. In addition, coexistence of the train-to-train communication and the train-to-wayside communication makes a real-time performance and reliability of information exchange higher, and a following train may know a running situation of a preceding train in time, so as to achieve a shorter train headway than that of a moving block. In the specification, cooperative control is introduced, which regards the multiple trains in the train formation mode as a system. Under the constraint of a scheduling instruction of automatic train supervision (ATS), a common driving objective is achieved, and besides, requirements for consistency and rapid convergence of a running state are met, thus guaranteeing running safety and efficiency of the train.

In a train formation control algorithm, a formation instruction is sent by the ATS of a ground center, and the sent instruction includes designation of a leader and a follower. The first train in the formation is designated as the leader, the rest trains in the formation are designated as the followers, and a train which does not receive the formation instruction does not participate in the formation. The first train running as the leader according to a timetable tracks an automatic train operation (ATO) curve, and the rest trains as the followers in the formation track a position and a speed of the first train.

3. An optimization objective and a constraint condition of the multi-train formation cooperative controller In the multi-train formation of urban rail transit, it is usually necessary to consider a train spacing and speed in the formation, and control the train spacing and speed in the formation to complete the formation. In the constraint condition, control over the train spacing and train speed uses an artificial potential field method.

As for a constraint on the train spacing, in a process of train formation, when a distance between two trains is relatively large, they will attract each other, and the farther the distance is, the more obvious the attraction will be. When two trains approach, the trains will repel each other, repulsion will be greater when the distance is closer. At this time, the trains will get away from each other until the distance between two trains stabilizes to an expected value, and then the trains will reach a stable state. A potential function for controlling distance between the trains is expressed as follows:

$$U_{is}(X_{ij})=\Sigma_{j=1}^{n}k_s*A_{ij}*\tan h(X_{ij}-d_{ij}) \quad (3)$$

where $X_{ij}$ is an actual running distance between train i and train j, $d_{ij}$ is an expected minimum safe distance between the train i and the train j, and $k_s>0$ determines a coefficient of input control; $A_{ij}$ is an adjacency matrix corresponding to a communication topology structure of a multi-train formation system; an internal variable of $A_{ij}$ is $a_{ij}$, which indicates an information sharing state between trains in the formation, $a_{ij}$ equaling 1 and 0 indicates that an information link is normal and abnormal respectively; when $X_{ij}=d_{ij}$, a distance control function between two adjacent trains equals 0, that is, when two trains have an expected distance, an absolute value of the distance control function is a global minimum; and when $X_{ij}>d_{ij}$, the potential function is positive, attraction between the two trains shortens the distance between the two trains to make the two trains approach each other, and when $X_{ij}<d_{ij}$, the potential function is negative, and repulsion occurs between the two trains to repel the two trains.

As for a constraint on the train speed, a potential function of speed control is introduced. The purpose of the potential function of speed control is to make the train speed in the formation reach consistency quickly, assist the potential function of distance control, and complete the multi-train formation quickly. A potential function of speed control is expressed as follows:

$$U_{iv}(V_i)=-\Sigma_{j=1}^{n}k_v*A_{ij}*\tan h(V_i-V_j) \quad (4)$$

where $k_v>0$ is a gain coefficient of the potential function, $V_i$ is an actual speed of the train i, and $V_j$ is a speed of another train in the communication topology.

A summed potential field of a distance potential field and a speed potential field is an output of a total potential field, and the total potential field is denoted as $U_i^{ARF}$.

$$U_i^{ARF}=U_{is}+(X_{ij})+U_{iv}(V_i)+U_{rep}(q_i) \quad (5)$$

The following describes the multi-train formation state observer.

In an actual train formation process, influence of noise on the convergence, accuracy and robustness of the algorithm should be considered in train formation. In the specification, we hope to use a filter algorithm to filter the noise so as to accurately estimate a position and a speed of the train. Kalman filter is an optimization estimation algorithm and a method for designing the state observer as well.

Taking formation of two trains on a main line as an example, a working principle of the state observer is described, as shown in FIG. 3, and there are two trains running successively on the main line. The trains are formed in a stable formation state. The following train already knows u[k] output by a potential function of the preceding train, after u[k] is executed by a power system of the preceding train, an actual state of the preceding train is x[k], and the state of the preceding train is sent to the following train through the train-to-train communication. The following train receives a state value of the preceding train as y[k], and y[k] is denoted as an observation value of the preceding train. It is already known through previous analysis that the state of the preceding train obtained by the following train may not be an accurate state x[k] of the preceding train due to an error of a train positioning speed measuring sensor and a communication delay, which requires the following train to observe the state of the preceding train. In an on-board controller of the preceding train, a train formation algorithm outputs u[k], the power system of the train executes u[k], and the actual state of the train is x[k].

An objective of the state observer is to get an actual real state x[k] of the train as accurate as possible. Since an ideal measured value y[k] of the sensor is in one-to-one correspondence with the actual state xk of the preceding train, the y[k] may be converged to y[k], such that x[k] is guaranteed to be converged to x[k].

Further, mechanical noise is denoted as ω[k], and the noise is random. These random variables do not follow a pattern, but an average attribute of the noise may be obtained by using a probability theory. It is assumed that the noise ω[k] obeys Gaussian distribution with a mean value of zero and covariance of Q, namely ω−N (0, Q). Since there are two outputs in the train dynamic model, and dimensions of the position and the speed are different, Q is a covariance matrix. Then, a train dynamic equation containing the noise is as follows:

$$x[k]=Ax[k-1]+Bu[k]+\omega[k] \quad (6)$$

In the train formation mode, a formation member makes a control strategy according to the position, the speed, etc. of other trains, but at this time, states of a position, a speed, etc. of other trains received by the train is also unreliable, due to errors of train self-positioning and speed measurement and noise existing in the train-to-train communication. The noise of the kind is denoted as μ[k], which obeys Gaussian distribution with a mean value of zero and covariance of R, μ-N(0, R).

A mathematical model of a train power unit is shown in formulas (2-13):

$$\hat{x}[k]=A\hat{x}[k-1]+Bu[k] \tag{7}$$

Where $\hat{x}[k-1]$ is estimation of an optimal state of a previous cycle. A train state obtained by the on-board sensor of the train under the ideal condition is the actual state of the train, that is:

$$\hat{y}[k]=C\hat{x}[k] \tag{8}$$

where C is an elementary matrix. An observation formula as shown in (2-15):

$$y[k]=Cx[k]+\mu[k] \tag{9}$$

In the above formula, $A\hat{x}[k-1]+Bu[k]$ is called a prediction portion. Using an estimation state $\hat{x}[k-1]$ of the previous communication cycle and u[k] output by an current train formation algorithm, the prediction portion is denoted as $\hat{x}^-[k]$, called an estimated state value of the train state in the cycle. A measured value y[k] of the on-board sensor is put into the equation, and the estimated state value is updated with y[k]. At this time, the $K_k(y[k]-C\hat{x}^-[k])$ portion is called posterior state estimation.

There are two processes needed by the following train for obtaining accurate state information of the preceding train. The first is a prediction process, which is used to calculate an estimation value $\hat{x}^-[k]$ of the train state and error covariance $P_k^-$. Because of mechanical delay in design, uncertainty of the estimated train state value is caused. $P_k$ represents measurement of uncertainty of train state estimation, and $\hat{x}[k-1]$ and an initial value of $P_{k-1}$ come from an initial estimation value.

$$\hat{x}^-[k]=A\hat{x}[k-1]+Bu[k] \tag{10}$$

$$P_k^-=AP_{k-1}A^T+Q \tag{11}$$

An observation process is described next. The observation process updates and calculates the train state on the basis of an estimation result obtained in the prediction process.

$$\hat{x}[k]=+[k]+K_k(y[k]-C\hat{x}^-[k]) \tag{12}$$

$$P_k=(I-K_kC)P_k^- \tag{13}$$

$$K_k=P_k^-C^T(CP_k^-C^T+R)-1 \tag{14}$$

$\hat{x}[k]$ is an updated state value, $P_k$ is updated error covariance, $K_k$ is a Kalman gain, and the Kalman gain is iterated in the algorithm to minimize the error covariance $P_k$ of the updated state value.

The present disclosure has the following beneficial effects:

to guarantee safe and efficient operation of train formation, in the present disclosure, the trains are modeled as a discrete linear time-invariant system, relative distance and a relative speed between the trains are taken as constraint conditions for controlling multi-train formation, in addition, influence of noise in an actual formation process is considered, and a Kalman filtering state observer is introduced to guarantee convergence and robustness of a potential field algorithm. According to a control strategy provided by the present disclosure, the train headway may be effectively shortened, and train resources on a line may be flexibly configured by means of the train formation as well, such that the control strategy has important practical significance.

In order to verify effectiveness of the method for cooperative control of multiple trains based on an artificial potential field method proposed in the patent, a simulation experiment on a performance of the controller is performed and an experimental result is analyzed in this section.

It is assumed that there are four trains to be formed in the scene of two stations and one interval, a first train runs according to a timetable, and the other three trains are controlled by a cooperative control algorithm. The influence of changes of a train length and train mass and noise is not considered in simulation. Considering the coexistence of the train-to-wayside communication and train-to-train communication, it is assumed that all trains in the formation may realize point-to-point communication. Therefore, a communication topology association matrix between all trains is as follows:

$$D=\begin{bmatrix}0&1&1&1\\1&0&1&1\\1&1&0&1\\1&1&1&0\end{bmatrix} \tag{15}$$

In addition, a position and a speed of the train are marked in a track direction. An initial distance between the trains is 30 m, and initial speeds are all 0. Then an initial position and an initial speed of the train nav be expressed with a matrix as follows $$\begin{bmatrix}X_1\\X_2\\X_3\\X_4\end{bmatrix}=\begin{bmatrix}90\\60\\30\\0\end{bmatrix},\begin{bmatrix}V_1\\V_2\\V_3\\V_4\end{bmatrix}=\begin{bmatrix}0\\0\\0\\0\end{bmatrix} \tag{16}$$

Under the constraint of the train running timetable, working conditions of the first train in a whole running process include traction, inertia and braking. Running conditions of other trains are led and constrained by the first train, while the other three trains are gradually formed under the action of the cooperative control algorithm. FIG. 4, shows changes of the train speed with time. The first train runs according to the timetable, and it may be seen that the speeds of the four trains are identical within 30 s, which is because both the first train and other trains in the formation are in traction at maximum acceleration in an initial stage, and the first train changes from traction to coasting at 30 s, during which there is merely basic resistance, and the other trains are affected by the first train so as to be changed in the working conditions. It may be seen that under a leader-follower control strategy, the working condition of the first train is constrained by the timetable, so as to guarantee that the train arrives at a station on time under a safety constraint and enable passengers to get up and take off, thus ensuring efficiency of the train in executing a plan or a task. The train always runs below a maximum speed limit of 22 m/s during a tracking process, which guarantees safety of traveling. Since an objective of virtual formation is to guarantee that each train in the train formation runs at a very short distance at a high speed to realize rapid transport by trains and match changes and distribution densities of passenger flow, a relative dynamic relationship between the trains is extremely important in the process. FIG. 4 is a schematic diagram of a train speed in a formation mode.

In an entire running process, the distance between the trains is an important index for measuring algorithm quality. FIG. 5 is a schematic diagram of a distance between adjacent trains in a formation mode. FIG. 5 represents the distance between trains, specifically represents, from top to bottom, a distance between trains 1 and 2, a distance between trains 2 and 3, and a distance between trains 3 and 4 in turns. It may be seen that the distance between the trains continues to increase in a stage of a traction working condition of the first train, and decreases continuously after the first train changes from traction to coasting at 30 s. At 140 s, the distance between the trains 1 and 2 tends to be stable at first, followed by the distances between the trains 2 and 3 and the trains 3 and 4. In 200 s, the distance between the trains will fall within a desired distance range and tend to stabilize with the distance between the trains being 10 m.

In the process of train formation, a control decision of each train is affected by a position, a speed, a target speed, etc. of other trains in the formation. A train control strategy of the train is represented by acceleration of the train. Therefore, FIG. 6 shows acceleration of a train in a formation mode. A change of the control decision of the train is analyzed with the acceleration, and it may be seen that the acceleration changes relatively obviously, which is in line with features of real-time dynamic control of the control algorithm. When a train distance does not reach an ideal distance and the train speed does not reach an expected speed, the train is adjusted in state in real time, namely in dynamic balancing.

The above is merely preferred particular embodiments of the present disclosure, but a protection scope of the present disclosure is not limited thereto. Any change or substitution that may be easily thought of by any person familiar with the technical field within the technical scope disclosed by the present disclosure should be covered within the protection scope of the present disclosure. Therefore, the protection scope of the present disclosure should be subject to a protection scope of the claims.

What is claimed is:

1. A method for cooperative control of multiple trains, comprising:

S1, establishing a train dynamic model of urban rail transit;

S2, modeling a train control system of urban rail transit based on train-to-train communication;

S3, constructing, according to the dynamic model and a control system model, an optimized control target which comprehensively considers distance convergence and speed convergence of train formation; and S4, cooperatively controlling, on the basis of an artificial potential field method and Kalman filtering and according to the optimized control target, the multiple trains;

wherein S2 comprises:

adding the train-to-train communication to a communication-based train control (CBTC) system to realize coexistence of the train-to-train communication and train-to-wayside communication, exchanging by trains running in formation, information with a control center through the train-to-wayside communication and information with adjacent trains through the train-to-train communication; adding train cooperative operation to trains except a first train in a formation running mode to make state decisions; and sending, in a train formation control algorithm, a formation instruction by automatic train supervision (ATS) of a ground center, the sent instruction comprising designation of a leader and followers, specially, designation of the first train in the formation as the leader, and the rest of the trains in the formation as the followers, the first train running as the leader according to a timetable tracking an automatic train operation (ATO) curve, and the rest trains as the followers in the formation tracking a position and a speed of the first train.

2. The method according to claim 1, wherein step 4 specifically comprises:

S41: collecting real-time running states of the trains in a communication topology and obtaining a position and a speed of each train;

S42: inputting the position and the speed of each train into a potential function and the Kalman filter;

S43: calculating u[k] for each train according to the state potential function and the Kalman filter;

S44: applying the u[k] to each train; and

S45: repeating steps S41-S44 until the trains run to a destination.

3. The method according to claim 2, wherein step 43 specifically comprises:

step 431, establishing, by a following train, communication with a preceding train;

step 432, receiving, by the following train, u[k] output by the potential function of the preceding train;

step 433, receiving y[k], by the following train, of the preceding train, y[k] comprising a speed and a position;

step 434, calculating $\hat{x}[k]$ by the following train according to a dynamic mathematical model of the preceding train;

step 435, calculating $\hat{y}[k]$ by the following train according to a mathematical model of an on-board sensor of the preceding train;

step 436, determining, by the following train, whether $\hat{y}[k]$ is converged to y[k], indicating that $\hat{x}[k]$ is converged to x[k] if a determination result is yes, and proceeding to step 433 if the determination result is no; and step 437, using, by the following train, convergent x[k] to calculate u[k] output by the potential function of the following train.

4. The method according to claim 3, wherein step 432 specifically comprises:

a potential function for controlling distance between the trains being expressed as follows:

$$U_{is}(X_{ij})=\Sigma_{j=1}^{n}k_s*A_{ij}*\tan h(X_{ij}-d_{ij}) \quad (3)$$

wherein $X_{ij}$ is an actual running distance between train i and train j, $d_{ij}$ an expected minimum safe distance between the train i and the train j, and $k_s>0$ determines a coefficient of input control; $A_{ij}$ is an adjacency matrix corresponding to a communication topology structure of a multi-train formation system; an internal variable of $A_{ij}$ is $a_{ij}$, which indicates an information sharing state between trains in the formation, $a_{ij}$ equaling 1 and 0 indicates that an information link is normal and abnormal respectively; when $X_{ij}=d_{ij}$, a distance control function between two adjacent trains equals 0, that is, when two trains have an expected distance, an absolute value of the distance control function is a global minimum; and when $X_{ij}>d_{ij}$, the potential function is positive, attraction between the two trains shortens the distance between the two trains to make the two trains approach each other, and when $X_{ij}<d_{ij}$, the potential function is negative, and repulsion occurs between the two trains to repel the two trains;

a potential function of speed control being expressed as follows:

$$U_{iv}(V_i)=-\Sigma_{j=1}^{n}k_v*A_{ij}*\tan h(V_i-V_j) \quad (4)$$

wherein $k_v>0$ is a gain coefficient of the potential function, $V_i$ is an actual speed of the train i, and $V_j$ is a speed of another train in the communication topology; and a summed potential field of a distance potential field and a speed potential field being an output of a total potential field, the total potential field being denoted as $U_i^{APF}$ $$U_i^{ARF}=U_{is}(X_{ij})+U_{iv}(V_i)+U_{rep}(q_i) \quad (5).$$

5. The method according to claim 1, wherein step 1 specifically comprises:

the train dynamic model being:

$$x[k+1]=Ax[k]+Bu[k] \quad (1)$$

wherein x[k] is a train state in a $k^{th}$ communication cycle, u[k] is a potential field value output by a potential function, and A and B are parameter matrices separately;

the train state x[k] being expressed as follows:

$$x[k]=[s_i[k],v_i[k]]^T \quad (2)$$

wherein $s_i[k]$ and $v_i[k]$ represent a position and a speed of a train respectively.

6. A device for cooperative control of multiple trains, comprising a processor; and a memory having program instructions stored, wherein when the processor executes the program instructions stored on the memory, the processor is configured to:

establish a train dynamic model of urban rail transit;

model a train control system of urban rail transit based on train-to-train communication;

wherein the processor is further configured to:

add the train-to-train communication to a communication based train control (CBTC) system to realize coexistence of the train-to-train communication and train-to-wayside communication, exchange, by trains running in formation, information with a control center through the train-to-wayside communication and information with adjacent trains through the train-to-train communication; add train cooperative operation to trains except a first train in a formation running mode to make state decisions; and send, in a train formation control algorithm, a formation instruction by automatic train supervision (ATS) of a ground center, the sent instruction comprising designation of a leader and followers, specially, designation of the first train in the formation as the leader, and the rest trains in the formation as the followers, the first train running as the leader according to a timetable tracking an automatic train operation (ATO) curve, and the rest trains as the followers in the formation tracking a position and a speed of the first train;

construct, according to the dynamic model and a control system model, an optimized control target which comprehensively considers distance convergence and speed convergence of train formation; and cooperatively control, on the basis of an artificial potential field method and Kalman filtering and according to the optimized control target, the multiple trains.

* * * * *